US008353116B2

(12) United States Patent
Berrins

(10) Patent No.: US 8,353,116 B2
(45) Date of Patent: Jan. 15, 2013

(54) SANDAL WITH ADJUSTABLE STRAPS AND INTERCHANGEABLE MIX AND MATCH STRAPS AND INSOLES

(76) Inventor: Marlene Berrins, New York, NY (US)

( * ) Notice: Subject to any disclaimer, the term of this patent is extended or adjusted under 35 U.S.C. 154(b) by 372 days.

(21) Appl. No.: 12/802,851

(22) Filed: Jun. 16, 2010

(65) Prior Publication Data

US 2010/0251570 A1 Oct. 7, 2010

Related U.S. Application Data

(63) Continuation-in-part of application No. 11/901,316, filed on Sep. 17, 2007, now Pat. No. 7,765,722.

(60) Provisional application No. 60/863,013, filed on Oct. 26, 2006, provisional application No. 60/923,948, filed on Apr. 16, 2007.

(51) Int. Cl.
*A43B 3/24* (2006.01)
*A43B 3/12* (2006.01)

(52) U.S. Cl. ..... 36/101; 36/100; 36/11.5; 36/15

(58) Field of Classification Search ..... 36/101, 36/100, 11.5, 15, 135
See application file for complete search history.

(56) References Cited

U.S. PATENT DOCUMENTS 2,651,117 A * 9/1953 Harris ..... 36/112
6,282,818 B1 * 9/2001 Lu ..... 36/110
6,418,643 B1 * 7/2002 Yang ..... 36/101
6,442,869 B2 * 9/2002 Coomes ..... 36/11.5
6,442,870 B1 * 9/2002 Tsai ..... 36/11.5
6,718,658 B2 * 4/2004 Karasawa ..... 36/97
7,162,814 B2 * 1/2007 Berg et al. ..... 36/11.5
7,210,251 B1 * 5/2007 Rolle ..... 36/100
7,347,010 B2 * 3/2008 Yu ..... 36/11.5
7,578,076 B2 * 8/2009 Pawlus et al. ..... 36/100
7,765,722 B2 * 8/2010 Berrins ..... 36/101
2002/0174569 A1 * 11/2002 Tsai ..... 36/101
2005/0034332 A1 * 2/2005 Moschel et al. ..... 36/101
2007/0240335 A1 * 10/2007 Fitzgerald ..... 36/101
2010/0000128 A1 * 1/2010 Pearce ..... 36/101

* cited by examiner

*Primary Examiner* — Ted Kavanaugh

(57) ABSTRACT

A sandal which includes two molded plates which releasably lock together. The underside of the male plate contains a male lock, and its front and rear underside contain the reciprocal fasteners to secure the straps. The superior aspect of the female plate contains the reciprocal "female" releasable locking mechanism for the male lock. After the straps are secured on the male plate it is inserted and releasably locked when the underside lock of the male plate enters the superior lock of the female plate embedded in a base style (heel, flat or wedge). When the male plate with straps is the top layer its underside is the lock and its superior side is the contact support for the foot. The male plate functions as a middle lock if an insole is inserted under the straps and its underside is removably secured to a superior aspect of a male plate with a choice of hook and loop fastener. The insole becomes the final layer which hides the shoes components and provides the contact support for the foot.

1 Claim, 5 Drawing Sheets

Figure 1:
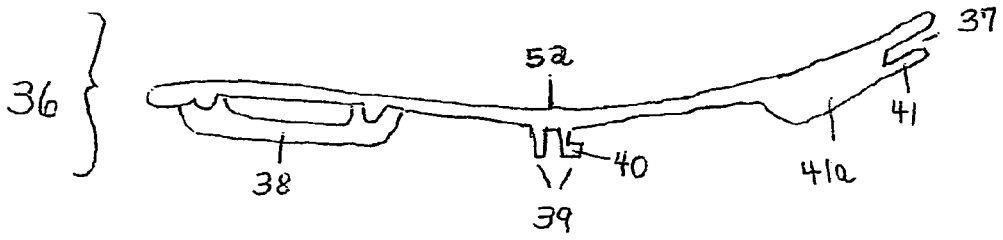

SANDAL WITH ADJUSTABLE STRAPS AND INTERCHANGEABLE MIX AND MATCH STRAPS AND INSOLES

REFERENCE TO RELATED APPLICATIONS

This continuation in part application is based on non provisional application 11,901,316 filed on Sep. 17, 2007, now U.S. Pat. No. 7,765,722 which is based on provisional application # 60/863,013 filed on Oct. 26, 2006 and provisional application # 60/923,948 filed on Apr. 16, 2007 the priority of which is claimed.

FIELD OF THE INVENTION

The present invention relates generally to footwear, and more specifically, to a sandal with adjustable and replaceable straps and replaceable insoles which are interchangeable to a variety of shoe bases to allow aesthetic and functional changes to the shoe

BACKGROUND OF THE INVENTION

Footwear comes in a vast variety of styles and designs to suit numerous functional and aesthetic goals. People are all individuals with variances in body parts, including their feet. Foot specifications vary in width, bone structure, toe lengths, protrusions, and varying positions of instep. One foot may be wider then the other. All feet are different and individuals are often uncomfortable in over the counter footwear. The present invention enables the consumer to adjust the straps in vertical & horizontal directions to increase their personal comfort. Custom molded shoes can be expensive and the present invention would offer this benefit for a moderate amount of money. The present invention also offers the consumer the ability to mix and match straps and insoles to a variety of base styles (heel, flat, or wedge) of the same size. Having each pair of straps mounted to its own plate makes it convenient to simply slide and lock into the base. It maintains the personal adjustment for next time. All of the possible variations increase the consumers ability to affordably increase their amount of foot attire.

BRIEF SUMMARY

A sandal comprised of layered footwear components containing a base of multiple styles (heel, flat, or wedge), all of which have a hollowed out center which creates a perimeter sidewall into which a molded female plate which completely fills the inside perimeter wall is inserted and permanently glued within to create one layer. Said bases and female plate may be molded as one piece if desired. The superior aspect of said female plate contains a receivable releasable locking mechanism for the next layer male molded plate. The male molded plate contains the reciprocal releasable locking mechanism for the female plate on its underside and a choice of hook and loop fastener (or other releasable fastening means) secured to the underside of the male plate. Straps which have reciprocal fastening means are attached to the underside of the male plate. Straps which are applied with non permanent fasteners are repeatedly adjustable and transferable to any male plate. Straps which are permanently applied to a male plate maintain its customized placement for comfort in vertical and horizontal directions for future use. All male plates with straps releasably combine with any style base. An additional padding may be permanently glued to the superior aspect of any male plate. An alternate design would be to releasably attach an insole to a male plate by inserting it under the straps and securing its underside to the superior aspect of the male plate with choice of hook and loop fastener (or another releasable fastener). The final layer insole or superior aspect of the male plate is the contact support for the foot which hides the shoes components and when assembled the sandal looks and functions like a usual and customary shoe design.

REFERENCES CITED

| | | |
|---|---|---|
| 6,418,643 | July 2002 | Yang |
| 0,174,569 | November 2002 | Tsai |

DESCRIPTION OF RELATED ART

Tsai and Yang both attach their straps to the shoe base. My design attaches the straps to a removable plate, and the adjusted straps are easily transferred on the plate to multiple base styles. There is much more flexibility and convenience for the consumer with my new design.

Neither invention allows for the straps to be adjusted both vertically and horizontally for maximum comfort.

My design is made from moldable parts and has minimal or no hardware. Straps snap in and out in seconds for convenience.

BRIEF DESCRIPTION OF SEVERAL VIEWS OF DRAWINGS

Figure 2:
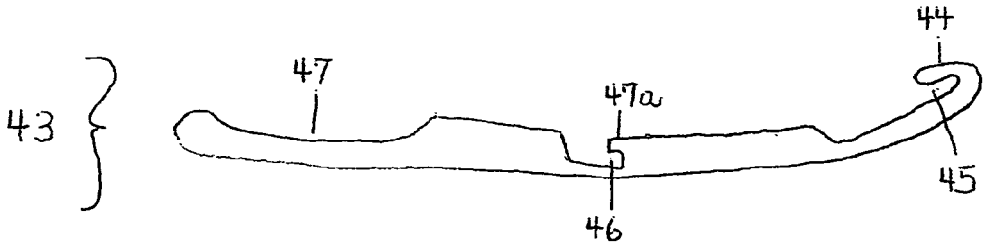

FIG. 1—is a split vertical view of the male molded plate whose superior aspect can function as a contact support for the foot and the reciprocal male protrusions on its underside which releasably lock into the superior aspect of the female plate (FIG. 2)

FIG. 2—is a split vertical view of the female molded plate and its superior aspect contains reciprocal sockets, and ledge locking mechanisms which releasably lock together with the underside protrusions of the male molded plate, and the underside of the female plate which will be permanently bonded within the perimeter ledge of a hollow shoe base.

Figure 3:
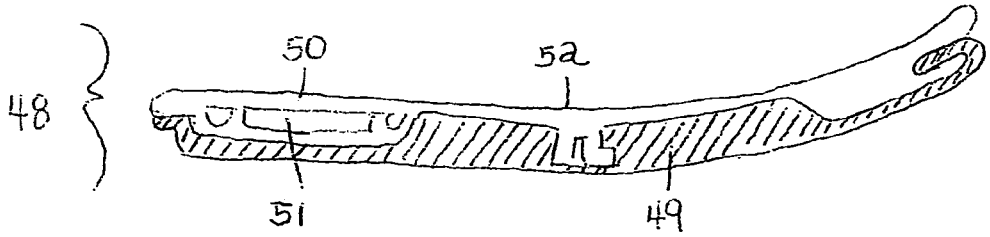

FIG. 3—depicts the male and female plates locked together

Figure 4:
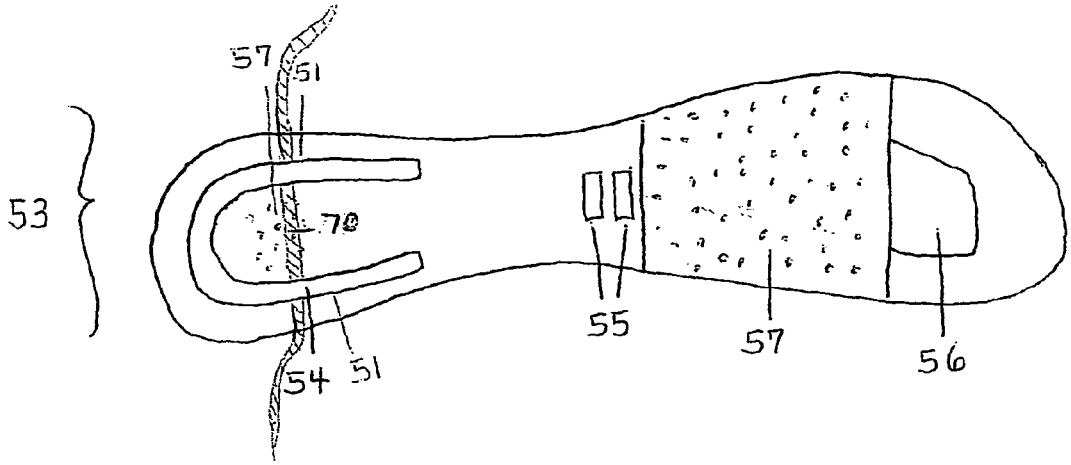
Figure 5:
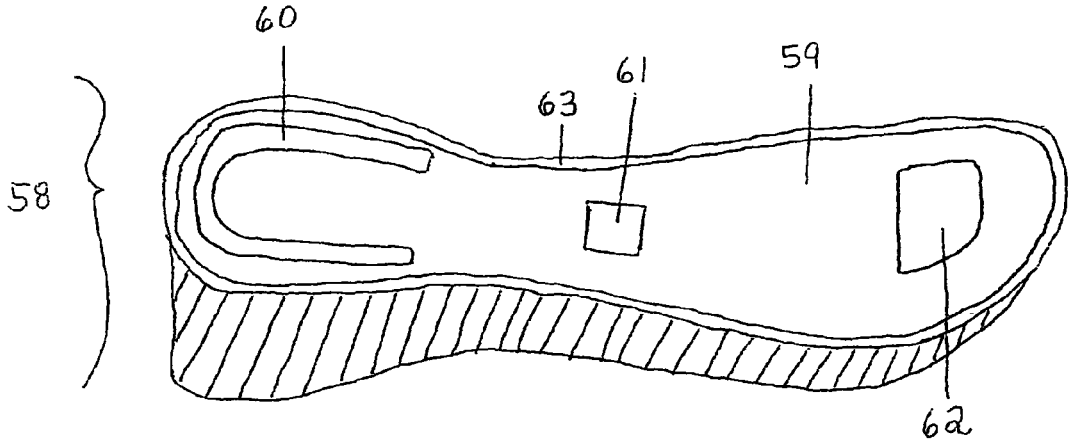
Figure 6:
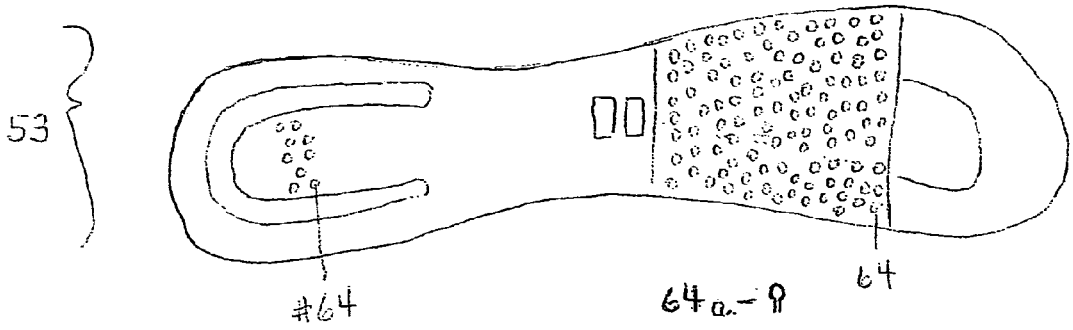
Figure 7:
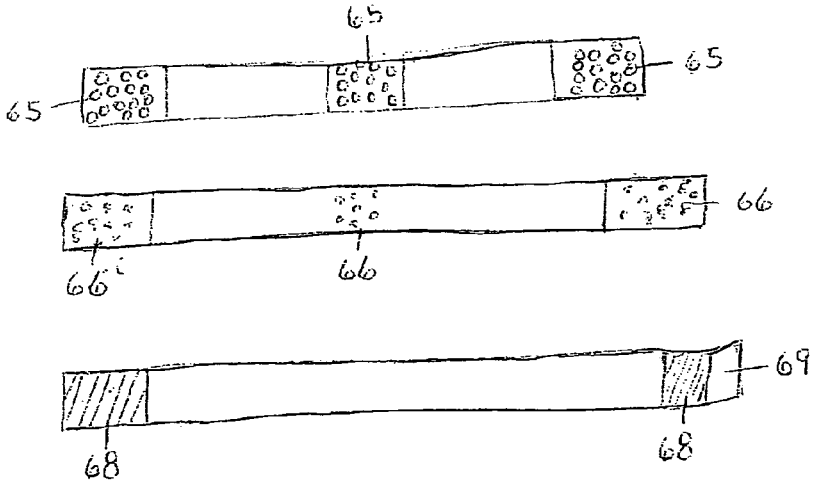
Figure 8:
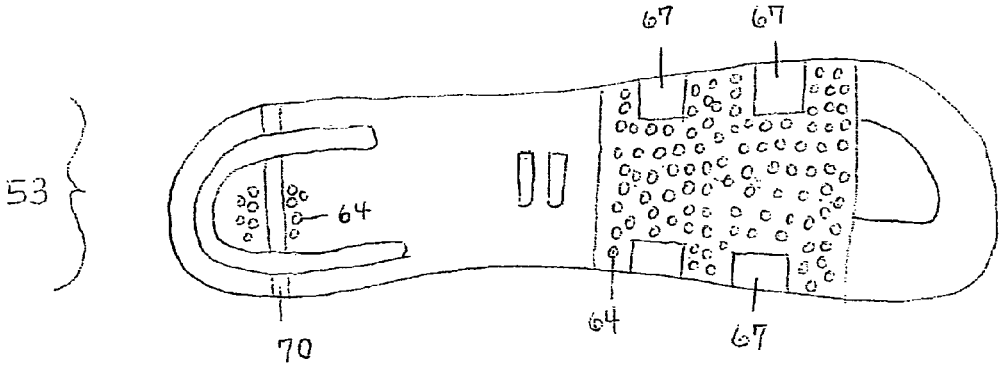

FIG. 4—depicts the underside of the male plate which includes a frontal, middle and rear protrusion snap locking mechanism and an underside choice of hook and loop fastener to exchangeably secure the shoe straps, and an ankle strap threaded horizontally across the heel area through spaces of the rear snap FIG. 5—depicts a shoe base with the female plate inserted and secured within the perimeter ledge of a hollowed out shoe base FIG. 6—front and rear areas on the underside of the male plate where multiple choices of fastening material for attaching straps is located FIG. 7—straps with reciprocal fastening means attached to various areas of its underside FIG. 8—Tips of straps in contact with corresponding fastener on underside of male plate and ankle strap threaded through rear snap outlet crosses the heel horizontally

DETAILED DESCRIPTION

A sandal according to the present invention includes two molded plates which reciprocally and releasably lock together.

FIG. 1 #36 depicts the underside of the molded male plate which contains a rear snap protrusion #38, a center lock protrusion #39 which contains a forward vertical projection #40, and a frontal projection lock #41*a*. which contains a vertical projection lock #41. The superior aspect of the male plate is the contact support for the foot #52, sometimes known as the insole. #37 is an empty space.

FIG. 2 depicts the molded female plate #43 whose superior aspect contains the Reciprocal releasable locking devices for the male plate. The rear socket #47, middle socket #46, and frontal socket #45, connect with the corresponding located locks of the male plate when joined together. #44 is a frontal ledge.

To insert the male plate into the female it is necessary to first insert the front lock #41 into the space #45 (of the female plate) by tilting the front of the male plate and first inserting the frontal lock #41*a*. and #41 and the middle lock #39 And #40 into the corresponding front and middle sockets of the female plate #45 & 46. After entering the open sockets the male plate is eased forward until it meets resistance which means it is locked into place under the front ledge #44, and middle ledge of the female plate #47*a* which will prevent it from lifting upward, and then the rear male lock #38 is pressed downward and snapped into the rear socket of the female plate #47

FIG. 3 depicts the male and female plates locked together #48. #51 is an open space through which the ankle strap is threaded FIG. 4—depicts the underside of the male plate with choice of hook and loop fastener applied to its front and rear underside #57. An underside view of the male plate depicts the rear snap #54, middle lock #55 and frontal lock #56.

FIG. 5—depicts the female plate #58 inserted within the perimeter wall #63 of the superior base #59, the rear female lock socket #60, mid female lock socket #61, and front female lock socket #62.

FIG. 6 depicts the underside area of the male plate where the fastening material example of multiple tiny snap protrusions #64 are molded onto the underside front and rear area of the plate. #65 is a horizontal view of a snap protrusion FIG. 7 depicts two choices of reciprocal releasable fastening materials attached to various underside areas of the straps being the female snap inlets #65 and hook and loop fastener #68, and one permanent fastener being glue #68 which is covered by a peel away tab #69 until ready for application.

FIG. 8 depicts tips of straps #67 in contact and secured with a choice of reciprocal fastener on the underside of the male plate, and an ankle strap #67 threaded through the rear snap outlet of the rear male snap crosses the heel horizontally

KEY TO DIAGRAMS

FIG. 1
36. SPLIT VERTICAL VIEW OF THE MALE PLATE (INSOLE)
37. HOLLOW SPACE
38. REAR SNAP PROTRUSION
39. MALE MIDDLE LOCK
40. VERTICAL PROTRUSION WHICH ENTERS LEDGE LOCATED IN CENTER LOCK OF SUPERIOR FEMALE PLATE
41. VERTICAL LOCK PROTRUSION WHICH ENTERS LEDGE ON FRONTAL LOCK OF FEMALE PLATE
41*a*. FRONTAL LOCK OF MALE PLATE
FIG. 2
42. OMITTED
43. SPLIT VERTICAL VIEW OF FEMALE PLATE
44. FRONTAL LEDGE
45. RECIPROCAL SOCKET FOR MALE FRONTAL LOCK PROTRUSION
46. RECIPROCAL SOCKET FOR MALE MIDDLE LOCK PROTRUSION
47. RECIPROCAL INDENTATION FOR MALE REAR SNAP PROTRUSION
47*a*. MIDDLE LEDGE
FIG. 3
48. MALE PLATE LOCKED INTO FEMALE PLATE
49. FEMALE PLATE
50. MALE PLATE
51. OPEN SPACE FOR INSERTION OF REAR ANKLE STRAP
52. CONTACT SUPPORT FOR THE FOOT
FIG. 4
53. UNDERSIDE OF MALE LOCK
54. UNDERSIDE VIEW OF REAR PROTRUSION LOCK
55. UNDERSIDE OF MIDDLE PROTRUSION LOCK
56. UNDERSIDE VIEW OF FRONTAL PROTRUSION LOCK
57. HOOK AND LOOP FASTENER
FIG. 5
58. HOLLOW CENTER OF SUPERIOR FEMALE SHOE BASE WITH SIDEWALL
59. FEMALE PLATE SECURED WITHIN PERIMETER WALL OF SHOE BASE
60. REAR FEMALE LOCK SOCKET
61. MID FEMALE LOCK SOCKET
62. FRONT FEMALE LOCK SOCKET
63. SIDEWALL
FIG. 6
64. MOLDED MALE SNAP PROTRUSIONS ON UNDERSIDE OF MALE PLATE
64*a*. A VERTICAL VIEW OF A MALE SNAP PROTRUSION
FIG. 7
65. FEMALE SNAP INLETS ON UNDERSIDE OF STRAPS
66. HOOK AND LOOP FASTENER ON UNDERSIDE OF STRAPS
68. GLUE FASTENER ON UNDERSIDE OF STRAPS
69. PEEL OFF TAB WHICH COVERS GLUE (HALF REMOVED)
FIG. 8
67. TIPS OF STRAPS SECURED TO UNDERSIDE OF MALE PLATE
70. ANKLE STRAP THREADED THROUGH SPACE OF MALE SNAP

The invention claimed is:

1. A sandal comprised of removable footwear components comprising:

a lower shoe base having a hollowed out central area with a perimeter sidewall;

a molded female plate sized to fit snugly within the perimeter sidewalls of the base is inserted and secured to the base, the female plate having a superior female lock on a topside of the female plate, the female lock having a middle ledge and a frontal ledge;

a readily removable molded male plate having an underside containing a releasable male lock and a rear snap protrusion, the rear snap having a through hole opening with an elongated shape so as to permit an ankle strap to be adjustable both horizontally and vertically, the male lock having a male middle lock and a frontal projection lock;

a plurality of straps having fastening material, wherein ends of the straps are folded under the male plate to secure the components of the strap and male plate together;

wherein the female plate locks together with the removable male plate and the plurality of straps by means of the releasable male lock, female lock and the rear snap protrusion, wherein the base, the male plate and the plurality of straps are all readily interchangeable with other footwear components to form multiple shoe base styles.

* * * * *